United States Patent [19]

Kessel et al.

[11] Patent Number: 4,711,281

[45] Date of Patent: Dec. 8, 1987

[54] CURVED WOOD BENDING MACHINE

[76] Inventors: Michael Kessel, 138 Preston Rd., Milford, N.J. 08848; Erwin Kessel, 124 Old Croton Rd., Flemington, N.J. 08822; Eugene Schneider, R.D. 3, Box 474, White House Station, N.J. 08889

[21] Appl. No.: 836,476

[22] Filed: Mar. 5, 1986

[51] Int. Cl.[4] ..... B27H 1/00

[52] U.S. Cl. ..... 144/256.1; 144/259; 144/269; 156/443; 156/583.8

[58] Field of Search ..... 156/443, 580, 583.6, 156/583.8; 144/256, 256.1, 259, 269

[56] References Cited

U.S. PATENT DOCUMENTS

| | | | |
|---|---|---|---|
| 927,975 | 7/1909 | Kaufman | 144/256.1 |
| 1,757,779 | 5/1930 | Navratil | 144/259 |
| 1,862,414 | 6/1932 | McAlister | 144/259 |
| 2,399,348 | 4/1946 | Hobbs | 144/256.1 |
| 3,835,904 | 9/1974 | Sumner | 144/259 |

*Primary Examiner*—W. D. Bray

[57] ABSTRACT

A curved wood bending machine for bending solid, veneered or laminated wooden members has a support frame with a generally planar top member on which a plurality of guide rails are connected in predetermined circumferential relationship and radial planes from a common counterpoint on the top member so that clamping assemblies slidably mounted on the guide rails can be moved by suitable associated actuating means on the guide rails to predetermined positions relative each other. The clamping assemblies have a fixed vertical shoe and a coacting movable shoe which is activated by a suitable fluid pressure device such as a pneumatically operated cylinder and plunger arrangement so that a desired curvature can be established to fit and bend an elongated wooden member therein. Suitable locking members are provided to prevent accidental movement of the clamping assemblies after they are set for the predetermined shape for bending the elongated wooden member and a safety shield is provided to prevent operation and or release of the fluid pressure device on the clamping assemblies.

Additionally, the curved wood bending machine, as above described wherein at least one or more of the clamping assemblies include, a two part base means for the operatively associated fixed and movable shoes which can be locked relative to each other for offsetting the fixed and movable shoes of each of such clamping assembly from the longitudinal line of the associated guide rail on which the clamping assembly is mounted.

Additionally, the curved wood bending machine as above described including, a pair of coacting platens or expansion adapters to be connected to the fixed and movable shoes for increasing the area of and more uniformly distributing the curved wood bending machine.

14 Claims, 17 Drawing Figures

CURVED WOOD BENDING MACHINE

BACKGROUND OF THE INVENTION

This invention relates generally to wood bending machines and more particularly to a machine adapted to shape, form, bend set in a relatively short period of time solid or laminated wood strips into arcuate or curved forms for use, in custom crafted windows and doors, in wooden members for boats, pianos, furniture, and in other devices.

Machines or devices for shaping, forming, bending and setting solid, veneered or laminated strips of wood into arcuate or irregular shapes are known in the art.

Thus, for example machines or devices for shaping and setting frames or timbers used in the construction of boats and pianos are shown in U.S. Pat. No. 1,717,776; 229,198 and 333,615.

Other machines or devices are also known in the prior art which utilize a plurality of arcuately spaced clamping blocks either fixed or adjustably mounted on a table support to provide predetermined arcuate shapes for solid or veneered wood strips for doors and windows is shown in U.S. Pat. No. 927,975; 1,757,779 and 1,862,414.

Thus, in U.S. Pat. No. 927,975 the table support has a plurality of spaced parallel slots in which a corresponding plurality of clamping units are disposed, each clamping unit respectively mounted for manual movement in and along an associated parallel slot so that the respective clamping ends of the clamping units can be positioned and held relative the adjacent clamping unit to provide the desired arcuate shape for bending the elongated solid, veneered or laminated wood strip. Each of the clamping units have fixed or non-movable elements which are in alignment with respect to each other to provide the given arcuate shape, and coacting manually movable members, so that the board to be bent can be fixedly connected in the centrally located clamping unit and then bent from unit to unit serially and progressively away from the central unit and clamped by the movable clamping member progressively as the member is bent or set. In order to reset the apparatus, each of the clamping units must be moved along its respective associated parallel slot to whatever new position is required to provide a new predetermined arcuate shape.

In U.S. Pat. No. 1,757,779 the plurality of clamping units are fixed to the table top to permit the member to be bent to be clamped against a steel band which serves as the arcuate template for the desired arcuate design. The clamping units of the machine shown in this patent are fixed in position and can provide only a single arcuate shape.

Similarly, in U.S. Pat. No. 1,862,414 a plurality of clamping units are shown each of which has a fixed member. The fixed members on the respective clamping units are disposed in alignment with each other to form the desired arc to which the elongated solid veneered or laminated wood member is to be bent. Coacting with each of the fixed members is a clamping plate which is removably connectible as by suitable threaded means to the fixed member. The clamping plate acts to hold the elongated wooden member against the fixed member during the use of this machine. The clamping units can be adjustably positioned to establish a predetermined arcuate shape by means connecting the respective clamping units into a plurality of spaced apertures which are drilled into the table top to which the respective clamping units are connected.

Other patents show means for forming arcuate laminated trusses or beams for structural elements in building construction such as is shown in U.S. Pat. No. 2,399,348 and 3,835,904.

In U.S. Pat. No. 3,835,904 a mechanical device is shown for forming laminated beams by pressing freshly glued strips of wood against a rigid steel frame and holding them in assembled position until the beam is set and fixed into the disired shape.

In U.S. Pat. No. 2,399,348 a machine is shown for making laminated trusses or beams in which a plurality of parallel guideways provide means for pressing the laminated strips against a corresponding plurality of fixed vertically disposed studs which are positioned and shaped into the desired arcuate shape for the beams. The movable compression or pressing elements are reciprocably mounted and are arcuate towards and away from the aligned vertically disposed studs by a suitable type of hydraulic fluid operated pistons which move the presser elements in the parallel guideways.

Still other mechanisms for wood bending are various types of molding machines in which a female mold is pressed against a male mold or vice versa to provide the desired form or shape for the wood to be bent as is shown in U.S. Pat. No. 1,461,471; 2,335,480, and 3,027,923.

The present invention provides a still further improved machine for bending elongated, solid, veneer or laminated wood strips into a given semi-circular, oval, elliptical or an irregularly curved shape as may be desired.

SUMMARY OF THE INVENTION

Thus, the present invention covers a curved wood bending machine for bending elongated wooden members into predetermined shapes comprising, a support means, a plurality of circumferentially spaced guide rails fixedly connected to the support means, each of said respective guide rails and having their longitudinal center lines disposed in a radial plane having a common center point, clamping unit means slidably disposed on each of the guide rails for movement to and fro along the longitudinal length of the guide rails, each of said clamping unit means including, means for engaging and holding a wooden member to be bent thereon, and actuating means on each of the guide rails operatively connected to the associated clamping unit means for moving the clamping unit means to a predetermined position relative each of the other clamping unit means to establish the predetermined shape for bending the wooden member held in and by the respective clamping unit means.

Additionally, the curved wood bending machine as above described wherein the clamping unit means includes, means to fix the relative alignment of the clamping unit means with respect to the longitudinal line of the associate guide rails to vary the arcuate alignment and shape established by the respective clamping unit means for the wooden member to be bent.

Accordingly, it is an object of the present invention to provide a wood bending machine which will eliminate the necessity for building temporary bending forms, jigs or the like devices heretofore used and which will eliminate the extensive labor time involved in the forming of arcuate or curved windows or doors as structural elements for construction purposes.

It is another object of the present invention to provide a wood bending machine of durable construction and material adapted to withstand the usage to which a machine of this kind which will be subjected in the production of such curved windows and doors.

It is another object of the present invention to provide an improved wood bending machine which is relatively simple to operate and which reduces very substantially the time required for the framing of curved windows, doors and other structural elements for construction purposes.

It is still another object of the present invention to provide an improved wood bending machine which facilitates the bending of elongated solid, veneered or laminated wood strips and which provides a relatively simple device for accomplishing the wood bending of such strips and it requires only a limited number of laborers for accomplishing the bending operations performed by this machine.

With these and other objects in view, the present invention will be best understood by reference to the accompanying description and claims when taken in connection with the drawings in which the following Figures are shown.

DESCRIPTION OF THE PREFERRED FORM OF THE INVENTION

Figure 1:
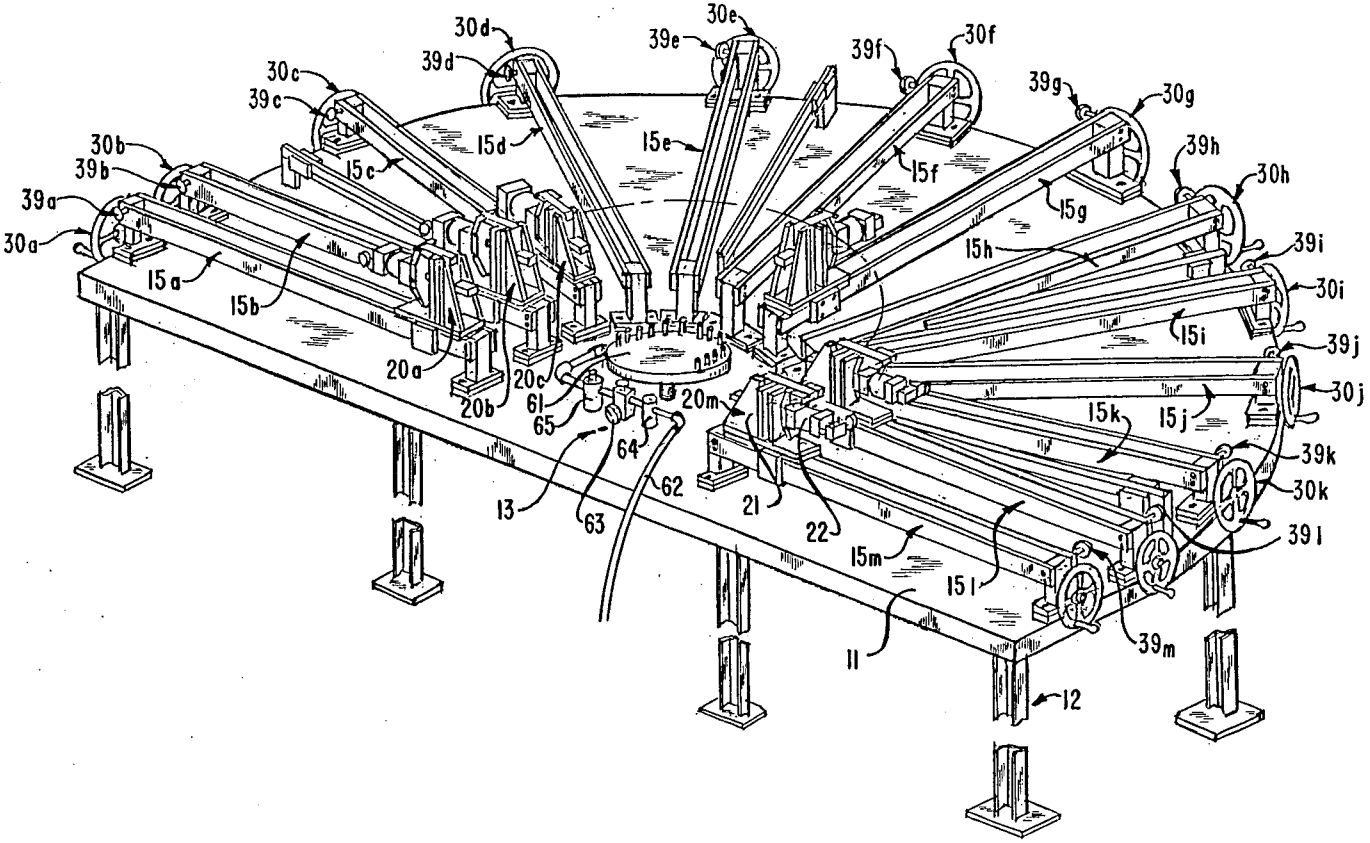
FIG. 1 is a perspective view of a preferred form of curved wood bending machine in accordance with the present invention.

Referring to the drawings the FIGS. 1 to 12 show one preferred form of curved wood bending machine generally designated 10 in accordance with the present invention.

Curved wood bending machine 10 is mounted on a generally flat planar semi-circular platform or top 11 of a supporting frame generally designated 12, the top being provided with a designated center point 13 at a medial point thereon inwardly of one transverse or side edge 14.

Figure 2:
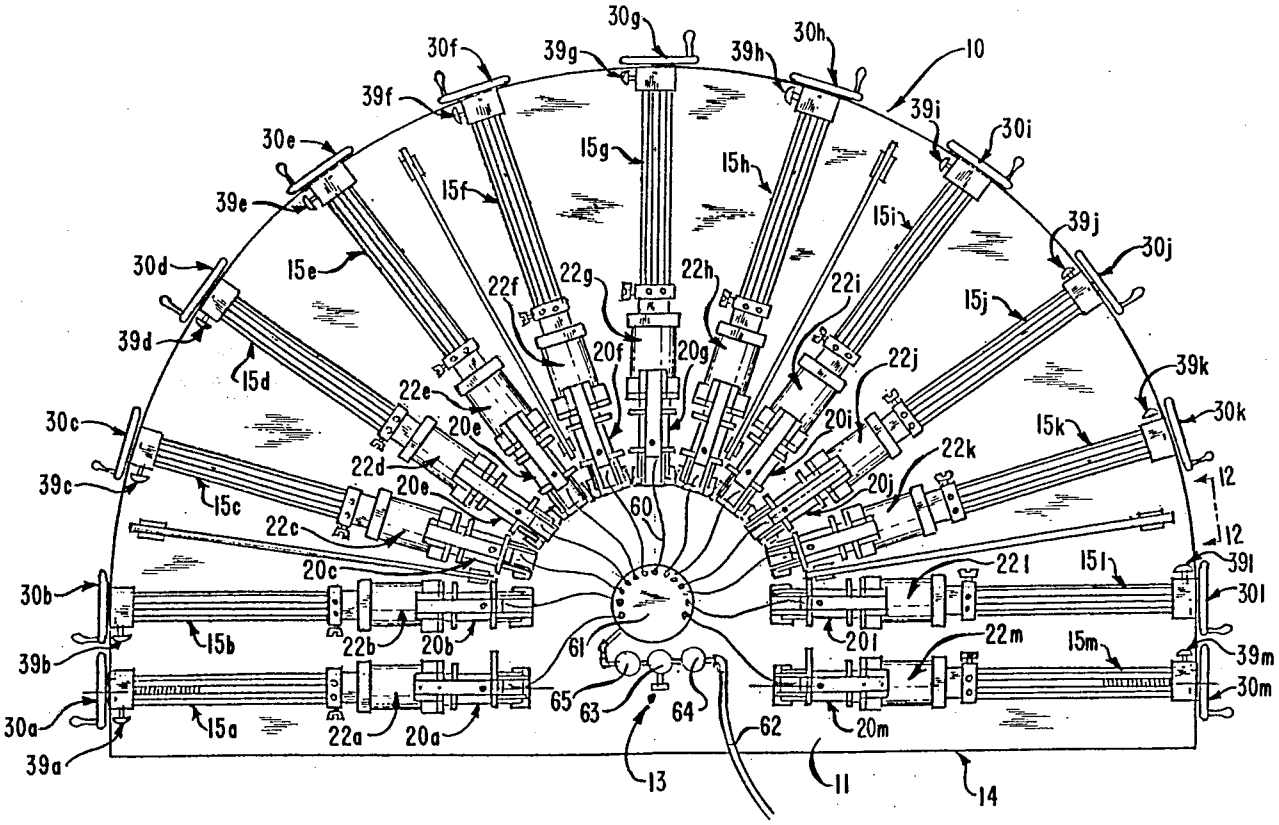
FIG 2 is a top planar view of the invention shown in FIG. 1.
Figure 3:
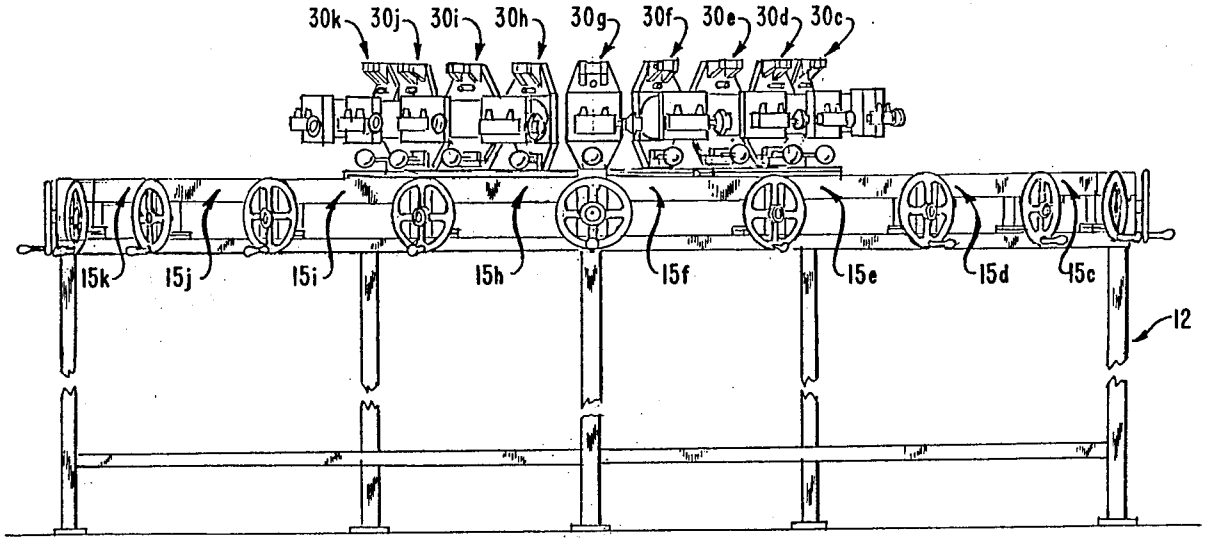
FIG. 3 is a back view of the form of the invention shown in FIG. 1.

Connected to the platform or top 11 is a plurality of circumfentially spaced guide rails 15*a*, 15*b*, 15*c*, 15*d*, 15*e*, 15*f*, 15*g*, 15*h*, 15*i*, 15*j*, 15*k*, 15*l*, and 15*m* which extend outwardly along predetermined radially extending centerlines, not shown, from the common center point 13 and by reference to FIGS. 1, 2 and 3 of the drawings. The predetermined spaced radially extending centerlines which provide the circumferential spacing for the guide rails 15*a* to 15*m* are established or limited by the available space on the upper surface of the platform or top 11 and the structural limitations of the available degree of angular bending to which the elongated solid, veneered or laminated wood members can be subjected as they are bent into the desired arcuate or irregular curved shape by the machine in accordance with the present invention.

Additionally, FIGS. 1, 2 and 3 show that one of the spaced guide rails 15*g* has a longitudinal centerline which lies in the radially extnding plane perpendicular to the common center point 13 and the transverse or side edge 14 on the platform or top 11.

The guide rails 15*a* to 15*m* each have slidably and movably mounted thereon identical clamping assemblies generally designated 20*a*, 20*b*, 20*c*, 20*d*, 20*e*, 20*f*, 20*g*, 20*h*, 20*i*, 20*j*, 20*k*, 20*l*, and 20*m* to be more fully described hereinafter and are also provided with identical actuating assemblies generally designated 30*a*, 30*b*, 30*c*, 30*d*, 30*e*, 30*f*, 30*g*, 30*h*, 30*i*, 30*j*, 30*k*, 30*l* and 30*m* each respectively disposed on its associated guide rail for actuating and moving the associated clamping assembly on the given guide rail as will also be more fully described hereinafter.

The guide rails 15*a* to 15*m*, the clamping assemblies 20*a* to 20*m* and the actuating assemblies 30*a* to 30*m* all being identical only one guide rail namely, guide rail 15*g* and its associated clamping assembly 20*g* and actuating assemblies 30*g* are illustrated as shown in FIGS. 4, 4*a*, 5, 6, 7 and 8 of the drawings.

The guide rail 15*g* is shown to include two generally parallel side elements as at 16 and 17 which are held in predetermined spaced relation to each other by an inner end bracket 18 and an outer end bracket 19 each respectively provided with an inner connecting bracket as at 18a and an outer connecting bracket as at 19a. The inner and outer end brackets 18 and 19 are sized to hold the guide rail 15g a predetermined distance above the platform or top 11 in the assembled position. The respective inner connecting bracket 18a and outer connecting bracket 19a are fixedly connected to the platform top 11 by any suitable means such as inner weldment 18b and outer weldment 19b so that the center line of the guide rail 15g lies in the exact plane of the radially extending centerline as above described, all of which is clearly shown in FIGS. 4, 5, 6, 7 and 8 of the drawings.

Figure 4A:
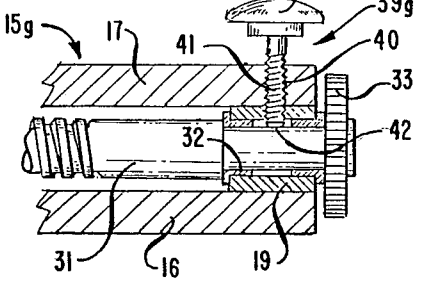
FIG. 4*a* is an enlarged horizontal section of a fragmentary portion of the outer end of the guide rail and clamping unit shown in FIG. 4.
Figure 4:
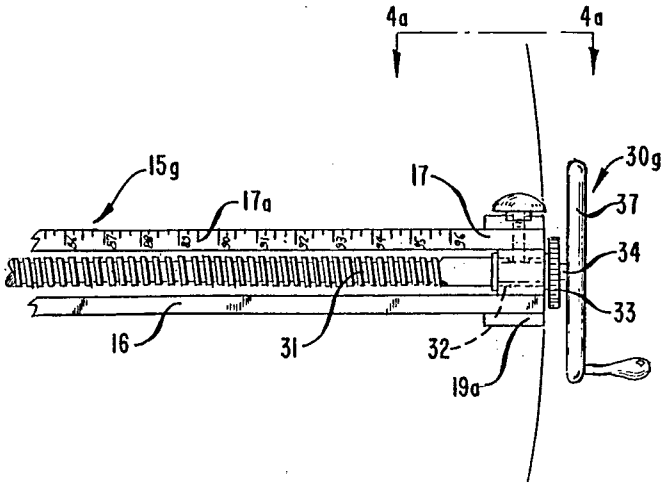
FIG. 4 is an enlarged top view of one of the guide rails with a clamping unit thereon of the curved wood bending machine shown in FIG. 1 with the clamping unit in the engaged position.
Figure 4:
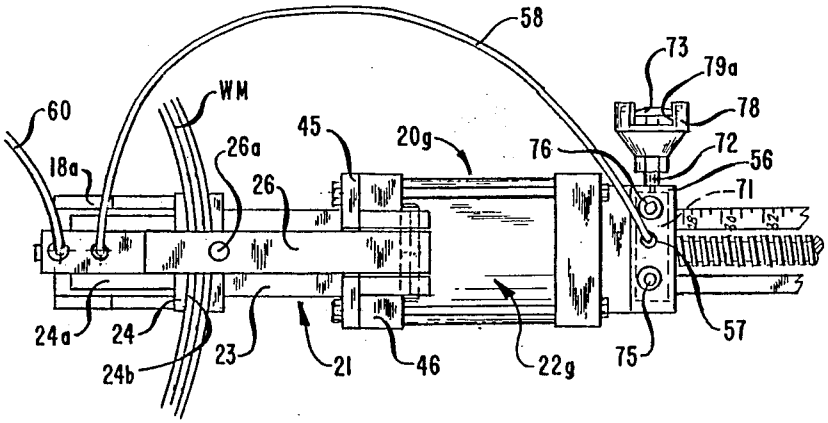

FIG. 4 shows that the upper face of guide rail 17 is provided with a plurality of spaced numerical measurements as at 17a to facilitate fixing the clamping assembly or unit 20g at a predetermined point on the guide rail during operation of the curved wood bending machine 10 in accordance with the present invention.

FIGS. 4, 5, 6, 7 and 8 also show that the clamping assembly 20g is slidably and movably mounted on the guide rail 15g and includes, a base section 21 and a plunger assembly section 22 which is pivotally connected to the upper portion of the base section 21 to permit the elongated solid laminated or veneered wooden material to be moved into and to be positioned in the base section 21 preliminary to the bending thereof. The base section includes a sized horizontal element or leg 23 and connected to the end of the horizontal leg or element 23 is a fixed vertical shoe or element 24 which is buttressed on the inner end of the guide rail 15g by a strong brace as at 24a between the horizontal leg and the fixed vertical shoe of the base section to enable the vertical shoe to support and withstand the pressures exerted during the bending of the wood material against the face 24b of the fixed vertical shoe 24 during operation of the curved wood bending machine 10.

The horizontal leg or element 23 is sized so that wood material from a thickness up to 5" can be easily positioned therein with one face of the wood against the fixed vertical shoe or element 24. Thus, a wide range of wood thicknesses can be achieved on curved wood bending machines in accordance with the present invention. Those skilled in the art will readily recognize that while a size limitation of up to 5" has been indicated for the horizontal leg or element 23 that this dimension has only been selected as illustrative because the devices such as windows for which this curved wood bending machine is particularly applicable do not generally exceed this thickness. However, appreciably greater thicknesses can be obtained by adjusting the size of the horizontal leg or element 23 as may be required for heavier thicknesses such as trusses for roofs, ribs for large sailing vessels or sounding boards for pianos and the like.

Similarly, the fixed vertical shoe or element 24 will be sized to receive wood material having a width up to 12". This to can be sized within the limits of the capability of the machine depending upon the materials from which the machine is made and the pressures exerted during the bending of the wood materials placed therein.

Connected to the uppermost end of the vertical shoe or element 24 and extending towards the outer end of the guide rail 15g a spaced distance from and substantially parallel to the upper face 25 of the horizontal leg or element 23 is a cantilevered beam 26. Cantilevered beam 26 will be sized approximately equal to the length of the upper face 25 of the horizontal leg or element 23 so that a plunger section 22 can be pivotally connected to the outer end of the cantilevered beam 26 remote from the vertical shoe or element 24 as by the pivotal connection or bearing means 27. The plunger section 22 can be pivoted from an operating position as shown in the solid lines of the drawings to a non-operating position as shown by the phantomized lines in FIG. 6 where it will rest on the rubber stop 26a on the uppermost face of the cantilevered beam 26. In the non-operating position the plunger section 22 will be pivoted so as to uncover or open the space defined by the upper surface 25 of the horizontal leg, the inner face 24a of the vertical shoe 24, and the lower face 26b of the cantilevered beam 26. The elastomeric stop 26a on the upper face of the cantilevered beam will prevent jarring or injury to the plunger section 22 during operation of the curved wood bending machine 10 all of which is shown in FIGS. 4, 5 and 6 of the drawings.

Figure 5:
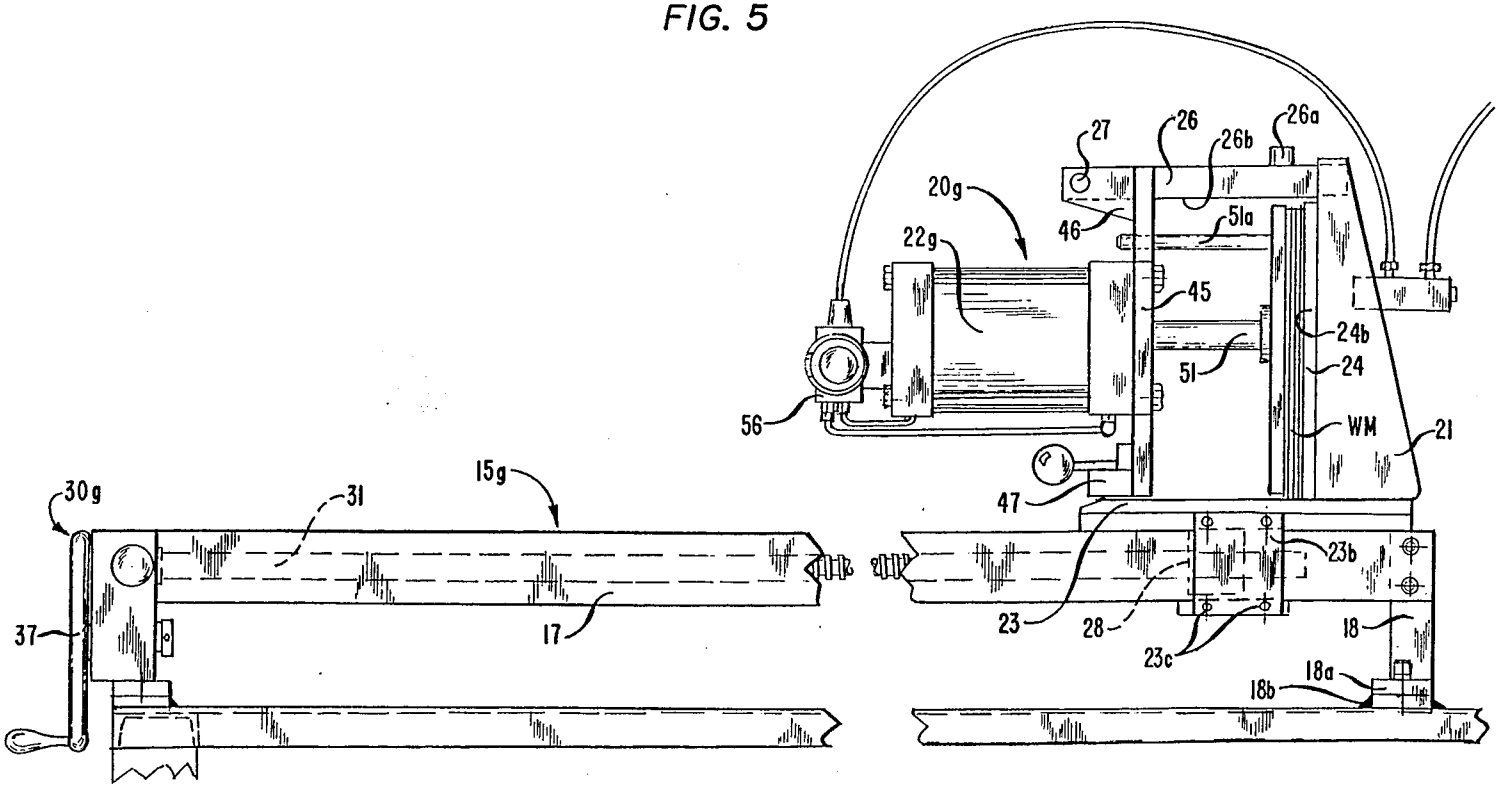
FIG. 5 is an enlarged side plan view of the guide rail and clamping unit shown in FIG. 4, with the clamping unit shown in engaged position.

FIG. 5 shows that the contacting face, i.e. the face 24b in engagement with the wooden member WM to be bent of the vertical shoe or element 24 on the side thereon remote from the brace 24a has a convex shape which facilitates contact with and the bending of the wooden member WM during the operation of the curved wood bending machine 10 as will be clear from the operation thereof as hereinafter more fully described.

Figure 6:
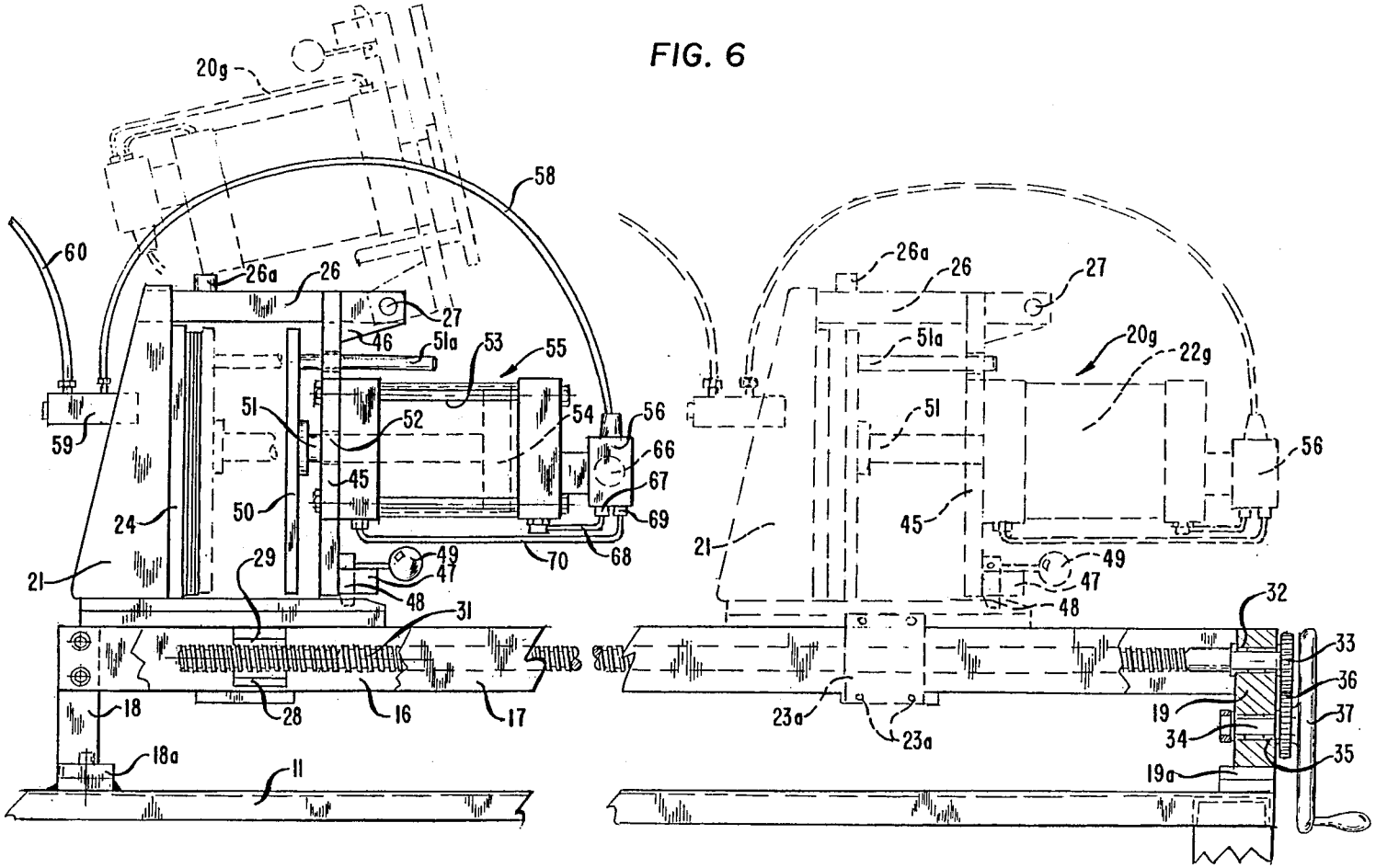
FIG. 6 is an enlarged side view of the guide rail and clamping shown in FIG. 4 with the movable shoe of the clamping unit shown in the engaged position in dashed lines, and in the disengaged position in solid lines, and the clamping unit is also shown pivoted to the non-operating position in dash dot lines, and the entire clamping unit is shown in a second position on the guide rails in phantomized lines.
Figure 7:
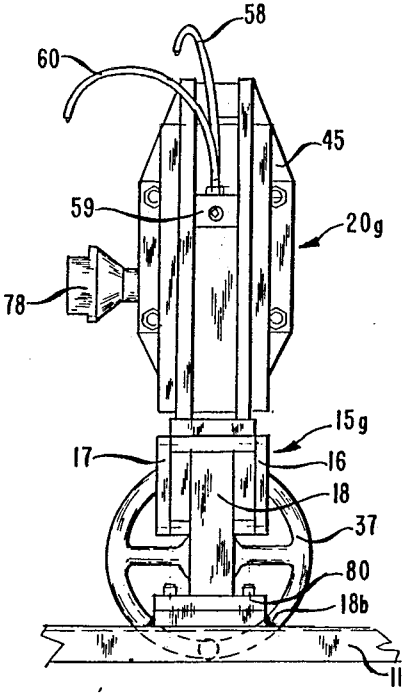
FIG. 7 is an enlarged front view of the guide rail and clamping unit shown in FIG. 4.

FIGS. 5, 6 and 7 also show that the clamping assembly 20g has a downwardly projecting trunnion or boss 28 which is sized to fit and move easily between the spaced tracks 16 and 17. Trunnion or boss 28 has a threaded bore 29 extending end to end therethrough in the longitudinal line of the guide rail 15g for connection to an elongated threaded shaft 31 on the actuating assembly 30g to be described hereinafter which provides means for sliding and moving the clamping assembly 20g to and fro on and along the longitudinal centerline of the guide rail 15g.

The clamping assembly 20g is held onto the guide rail 15g by relatively simple spaced connecting brackets 23a and 23b respectively on opposite sides of the outer faces of the tracks 16 and 17 which are connected as by threaded members 23c to the base section 23 of the clamping assembly 20g.

Thus, in assembled position the horizontal leg or element 23 of the base section which has a width at least as wide as the distance across the upper faces of the side elements 16 and 17 of the guide rail 15g rests on the upper surfaces of these side elements and the spaced connecting members 23a and 23b in assembled position engage or slide along the respective outer side faces of the side elements 16 and 17 and hold the base section 21 and hence the clamping assembly on the guide rail 15g when the clamping assembly is moved to and fro along the longitudinal centerline of the guide rail 15g by the actuating assembly 30g.

Actuating means 30g includes, the elongated threaded member 31 which is rotatably mounted at one end in a bushing 32 formed in the outer end bracket 19 of the guide rail 15g so that one end of the elongated threaded member extends to the exterior of the outer end bracket where it is fixedly connected to a gear element 33. The opposite or end remote from the gear connected end of the elongated threaded member is disposed for threaded engagement with the threaded bore 29 in the enlarged boss 28 on the clamping assembly 20g. Thus when the elongated threaded member 31 is rotated it will thread into and out of the threaded bore 29 causing the clamping assembly 20g to move to and fro along the associated guide rail 15g on which it is slidably and movably mounted, all of which is clearly shown in FIGS. 4, 4a and 6 of the drawings.

In order to rotate the elongated threaded member 31 a jackshaft 34 is rotatably mounted in a suitable second bushing 35 in the outer end bracket 19 and so positioned that suitable coacting gear means 36 connected to the jackshaft 34 and outboard thereof a hand wheel 37 is disposed for engagement with the gear means 33 and will drive the gear means 33 when the jackshaft 34 is rotated by the hand wheel 37 all of which is shown in FIGS. 4, 4a, 6, 7 and 8 of the drawings. Thus, when hand wheel 37 is rotated manually the gear 36 fixedly connected to the shaft 34 causes the gear 33 and elongated threaded member 31 connected thereto to also rotate. This causes the elongated threaded member 31 to thread into and out of the threaded bore 29a, thus moving the clamping assembly 20g to and fro along the upper surface of the side elements 16 and 17 of the guide rail 15g. The actuating assembly 30g thus makes it possible to position clamping assembly 20g and each of the actuating assemblies can also act to position each of their associated clamping assemblies at any specific radial distance along the longitudinal length of any one of the guide rails 15a to 15m so that the base members 21 on the respective clamping assemblies 20a to 20m thereon can be aligned at any predetermined radial position. Thus, the respective convex faces 24a of the respective clamping assemblies can be aligned to provide a given predetermined curvature for bending the wood material to be bent in the curved wood bending machine in accordance with the present invention.

In order to prevent the respective actuating assemblies 30a to 30m from operating after a radial position for its associated clamping assemblies 20a to 20m has been established, a safety lock generally designated 39a to 39m is provided on each of the actuating assemblies, one of which is illustrated as at FIG. 4a for guide rail 15g.

Thus, FIG. 4a shows that the safety lock 39g includes, a threaded bore 40 which extends throughout side element 17, the outer end bracket 19, and the bearing 32 of the guide rail 15g so that a threaded safety member 41 can be threaded therein into a contacting position as at 42 with the end of the elongated threaded actuating shaft 31 rotatably mounted in the bearing sleeve 32 in the outer end bracket 19 to lock the same in the set position or to a non-contacting position so that the elongated threaded actuating shaft 31 is free to be rotated again as above described. The threaded safety member 41 extends to the exterior of the outer surface of the side member 17 and this end is provided with a knob 43 which can be gripped manually and will serve to turn the threaded safety member into and out of engagement with the bearing end of the elongated threaded actuating shaft to prevent accidental rotation thereof until the safety lock 39g is rendered inoperative by manually rotating knob 43 so that the threaded safety member 41 is no longer in engagement with the bearing end of the elongated threaded actuating shaft 31.

While the aligned outer faces of the fixed vertical shoes or elements 24a of the respective clamping assemblies 20a to 20m provide the desired curved or bending shape for the wood material being bent, it is necessary in order to effect bending to first clamp the wood material to be bent into the curved position until it is set. This is accomplished by means of the plunger sections 22a to m of the respective clamping assemblies 20a to 20m.

As indicated above only plunger section 22g will be described because each of the plunger sections are identical for each of the clamping assemblies 20a to 20m.

Thus referring again to FIGS. 4, 5, 6, 7 and 8 of the drawings, the plunger section 22g is shown as having a generally planar support plate 45 which is provided with a yoke as at 46 at the upper end for connecting the clamping assembly 20g to the pivotal connection or bearing means 27 formed on the outer end of the cantilevered beam 26 on the base section 21 of the clamping assembly 20g. At the opposite end of the support plate 45 a slidable latch member 47 is provided for engagement with a strike 48 in the upper face of the horizontal leg or element 23 when the plunger section 22 is pivoted from the non-operative position to the operative position as is shown in FIG. 6. A manually operated lever 49 is lifted to release the latch member 47 and disengage it from the strike when it is desired to pivot the plunger section from the operative to the non-operative position.

The latch and strike mechanism will be structured so as to have sufficient strength to withstand the forces which will act between the inner face 24b of the fixed vertical shoe and the inner face or surface 50b of a movable shoe or plunger 50 fixedly connected to one end of a shaft 51 which extends through an opening 52 in the support plate 45 and into the cylinder 53 where it is connected to a piston member 54 disposed for free sliding movement inside the cylinder 53. The cylinder 53 and piston member 55 form part of a conventional pneumatically operated device generally designated 55 which is operated by charging air into opposite ends of the cylinder 53 so that the piston member 50 will slide the shaft 51 and movable shoe 50 towards and away from the fixed vertical shoe 24 when the pneumatically operated device 55 on the clamping assembly 20g is in operating position.

The inner face 50b of the movable shoe 50 will have a concave configuration or shape which will match the convex shaped inner face 24b of the fixed shoe 24 to facilitate both the accurate bending of the wooden member WM and the holding of this member until it is properly set. Additionally, a second shaft 51a a spaced distance from driving shaft 51 is provided to prevent the movable shoe 50 from misaligning or cocking when the bending pressures are exerted during operation of the plunger assembly 55.

Pneumatically operated cylinders and plungers as in the diagramatically illustrated drawings are well known devices which can be easily purchased on the open market and hence will not be described in great detail herein.

Air is delivered to the pneumatically operated cylinder and plunger assembly 55 through a conventional slide valve 56. Slide valve 56 has an inlet port 57 connected to one end of an ear delivery line 58 which is in turn connected at the end remote therefrom to a distributor head 59 which is supplied air through line 60 connected to the common manifold 61. The common manifold 61 is connected to an air source line 62 and suitable cut off valve 63 and safety valve 64 are provided in this air source line. A moisture filter 65 will also be provided.

The slide valve 56 has a hollow cylindrical space 66 which communicates with the inlet port 57 and is provided with a first outlet port 67 which communicates through line 68 with one end of the pneumatic cylinder 53 for delivering air into the end of the pneumatic cylinder for driving the piston or plunger member 54 in the cylinder forward thus moving the movable shoe 50 into operating position, and a second outlet port 69 which is connected by a line 70 with the opposite end of the pneumatic cylinder 53 to drive the piston member or plunger 54 back from the operating position to a non-operating position. The air delivery to said first operating port and second operating port is controlled by a valve head 71 in the slide valve chamber or space 66 which is connected to an operating shaft 72 which extends to the exterior of the slide valve 56 for connection to an operating knob 73 which is manually operated so that air can be passed to one or the other of the outlet ports 67 or 69 and in turn to one or the other side of the air cylinder 53 to move the the piston member or plunger 54 as above described. When this occurs air is simultaneously exhausted through a first exhaust outlet 75 as the plunger moves forward in the pneumatic cylinder. Conversely when the valve head 71 is moved in the opposite direction air will be delivered to the second outlet port for delivery to the air cylinder on the opposite side of the plunger and air will exhaust through the second exhaust outlet 76 in communication with the slide valve cylinder.

Figure 8A:
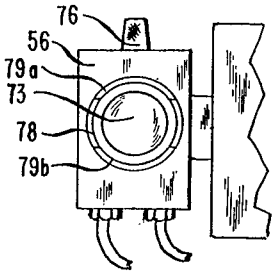
FIG. 8*a* is a side elevation view of the control valve for operating the clamping unit taken on line 8*a*—8*a* of FIG. 8.
Figure 8:
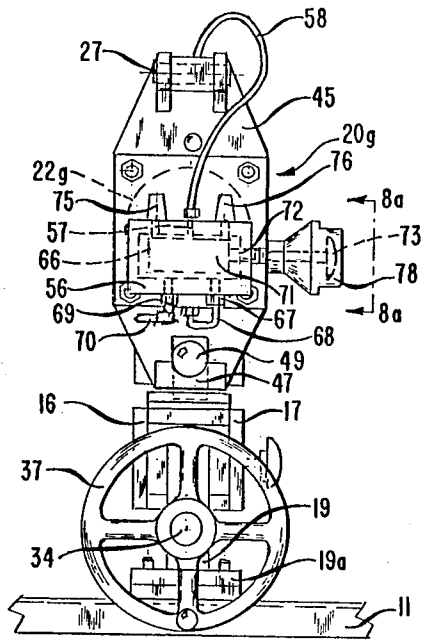
FIG. 8 is enlarged back view of the guide rail and clamping unit shown in FIG. 4.

The shaft 72 of the slide valve 56 moved manually by means of the knob 73 will extend through a safety housing or shield 78 in which the knob 73 is positioned to prevent accidental tripping thereof during operation of the curved wood bending machine 10. The safety housing or shield 78 has openings as at **79*a* and 79*b* to permit entry of the operator's fingers for manual operation, all of which is shown in FIGS. 8 and 8*a*** of the drawings.

FIGS. 1, 2, 12 and 13 show a plurality of supports 80 for levelor jigs 81. The levelor supports 80 are conected by an inner bracket 82 and outer bracket 83 to the top 11 of the support frame 12 and are dispersed at circumferentially spaced intervals between the guide rails. When the vertical dimension of the wooden member to be bent is less than the sized vertical dimensions for the fixed vertical shoe, then the levelor jigs are used to facilitate loading of the elongated wooden member into the clamping assemblies **20*a* to 20*m*** of the curved wood bending machine.

Figure 10:
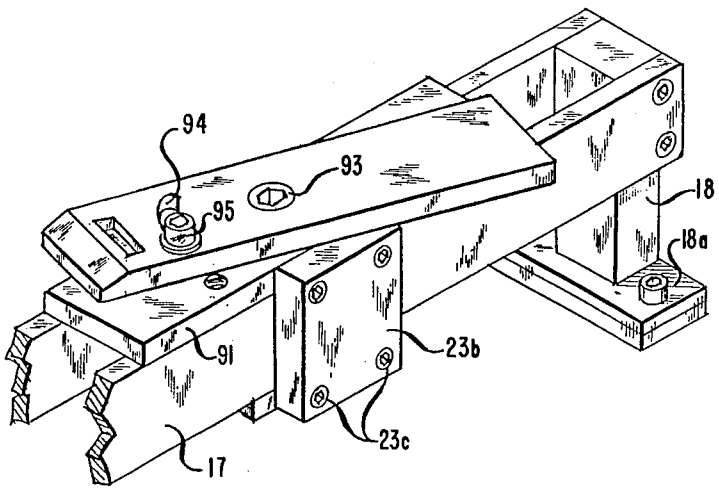
FIG. 10 is an enlarged perspective view showing the two part base section with the upper part pivoted relative the lower part thereon.
Figure 9:
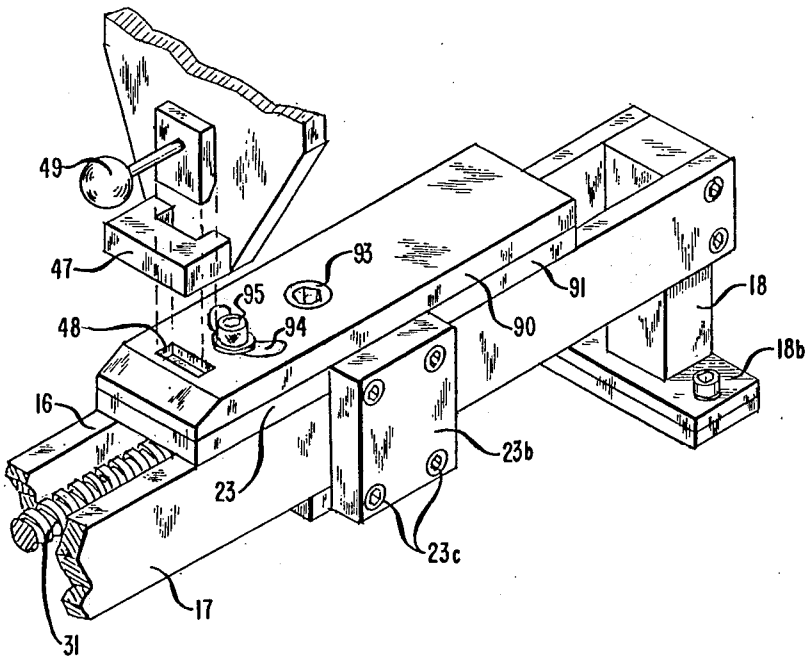
FIG. 9 is an enlarged perspective view of a fragment of the clamping unit showing the latch for holding the plunger section into engagement with the base section of the clamping unit.

FIGS. 9 and 10 show that the base member 23 can be made in two parts as at 90 and 91 so that the upper portion of the base member as at 90 can be pivoted about the fulcrum connection 93 to fix and offset the angular position of the respective clamping assemblies with respect to the longitudinal line of the associate guide rails. A suitable arcuate slot 94 and threaded member 95 can be provided to lock the upper member 90 with respect to the lower member 91 when the desired angular position is established only one member is illustrated because each of the base members 23 are the same for each of the clamping assemblies **20*a* to 20*m***.

Those skilled in the art will readily recognize that alternate variations of this arrangement to permit the movable section to be angled with respect to the fixed section of the base member may be used without departing from the spirit or scope of the present invention and that the above described means for changing said angle is only representative to demonstrate one means for accomplishing this result.

OPERATION

Initially all of the clamping assemblies **20*a* to 20 *m* are adjusted and set by their associated actuating assemblies 30*a* to 30*m* so the respective fixed vertical shoes 24 are aligned with respect to each other to the desired curvalinear shape to which the solid, veneer or laminated wood material is to be bent. This is done by rotating the hand wheel 37 to rotate the elongated threaded member 31 for actuating and moving each respective clamping assembly to the desired position. When the clamping assemblies are in the desired position the actuating assembly is locked in position by means of the respective locking mechanisms 39*a* to 39*m*** as above described.

All of the plunger assemblies are now pivoted to the open or non-operating position so as to clear the space formed by the inner faces 25, **24*b* and 26*b* of the horizontal leg 23, vertical shoe 24, and cantilevered member 26 on the base section 21**.

Now the elongated solid, veneered or laminated wood member or members are disposed with the medial or central point thereof in the space formed in the base section 21 of the center clamping assembly **20*g*. The plunger section 22*g* of clamping assembly 20*g* is now pivoted from the non-operating position to the operating position by locking the support plate 45 by means of the latch 49 and strike 48 as above described. Thereafter by manually pressing the knob 73, the slide valve is positioned to deliver air to the side of the piston member or plunger 54 in the pneumatic cylinder 53 of the clamping assembly 20*g* so as to move the concave inner face 50*b* of the movable shoe 50 into engagement with the side of the wooden members remote from the side disposed for engagement with the convex shaped inner face 24*b* of the fixed vertical shoe 24 in the base member 21**.

The elongated wooden member in this position can now be subjected to further engagement by the associated clamping assemblies respectively on opposite sides of the central member **20*g* serially, until the elongated wooden member is fixed into the desired curvalinear shape defined by the aligned fixed shoe 24. Thus, clamping assembly 20*f* and 20*h* on opposite sides of the clamping assembly 20*g* are next actuated, then clamping assemblies 20*e* and 20*i*** are next actuated, and so on serially until all of the clamping assemblies are in the operating or engaged position.

The wood member can then be held in this position until it is—set— so that the wood—loses its memory—and will not spring out of shape and will set to the desired curve. Suitable techniques for heating or treating the wooden members during these setting periods can be utilized to reduce the setting time and thus expedite the use of the curved wood bending machine in accordance with the present invention for production purposes.

In the case of laminated strips of wood that are glued together, it is necessary either to use a quick drying glue or alternatively to subject the glued member to some form of heating process so as to cause the glue to dry quickly and thus facilitate the quick formation and removal of the now curved and bent wooden member.

In order to remove the curved and bent wood member from the curved wood bending machine, the operation of the clamping assemblies is reversed. Thus, the plunger section on clamping assembly **20*a* and 20*m* are first operated through the manual knob 73 to cause the slide valve 56 to move the piston member 54 back and thus disengage the movable shoe 50 from engagement with the wooden member being bent and then the plunger sections on clamping assemblies 20***a* and 20*m* are unlatched and pivoted to the open or non-operating position. Then progressively the next adjacent clamping assembly 20*b* and 20*l* are disengaged and pivoted to the non-operating position, and this process is repeated until the center clamping assembly 20*g* is reached. When the plunger section of clamping assembly 20*g* is disengaged and pivoted to the open or non-operating position the wooden member can be removed from the curved wood bending machine 10 and thereafter trimmed, routed, cut and otherwise processed in accordance with the required procedure for finishing such members.

When the curved wood bending machine has a wooden member therein which has a relatively narrow width less than the approximate 12" width of the vertical leg or element 24, spaced leveling members 80 are used. By inserting a plurality of predetermined height adjustment levelors 81 the wooden member can be leveled in the curved wood bending machine 10 at the desired position and held in this position until the movable shoes of the clamping assemblies 20*a* to 20*m* are brought into engagement with the face of the wooden member on the side thereof opposite from the fixed vertical shoes of the respective clamping assemblies.

ANOTHER FORM OF WOOD BENDING MACHINE

Figure 13:
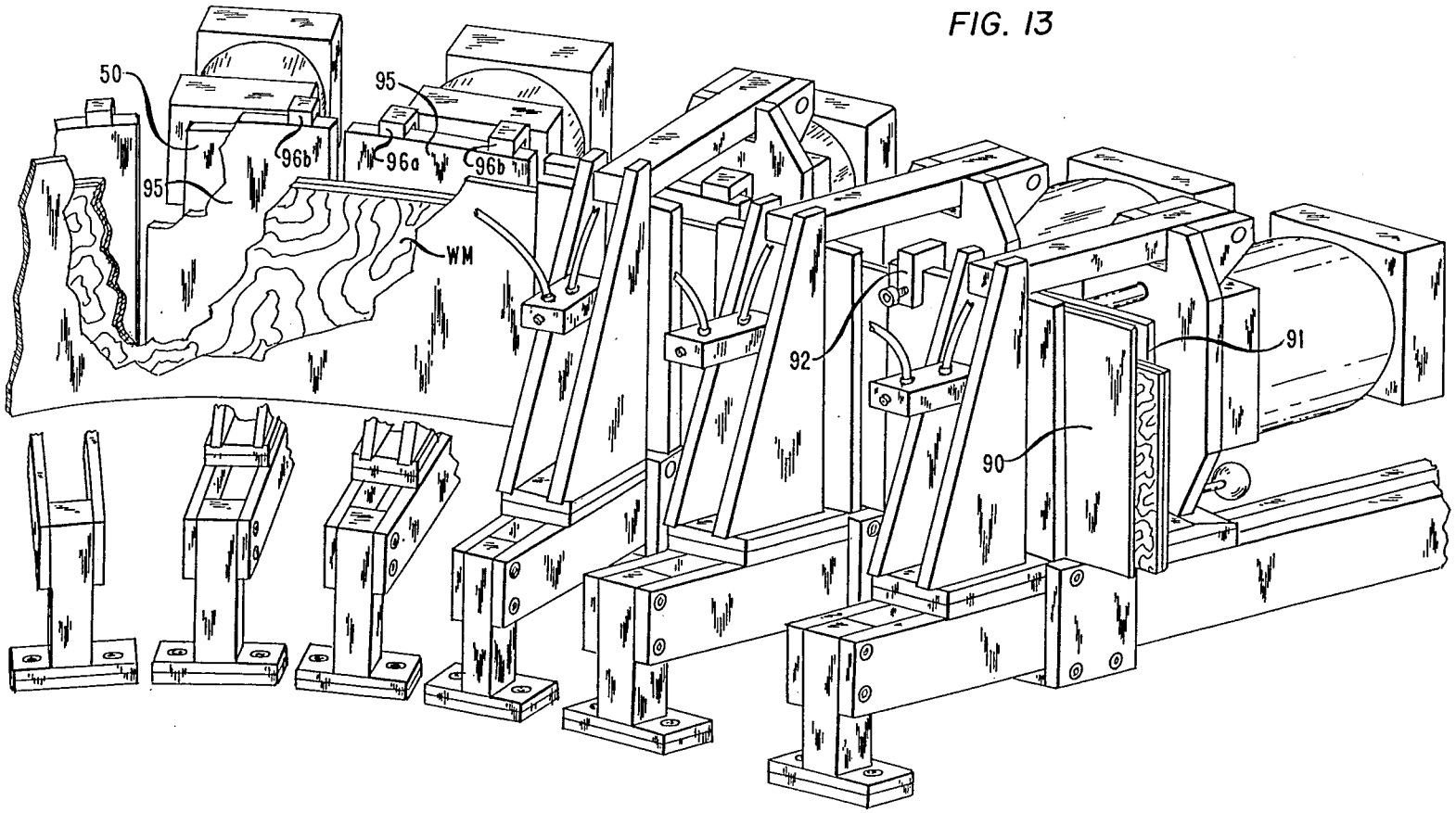
FIG. 13 is a fragmentary perspective view of a plurality of guide rails with clamping units thereon showing another form of the present invention.
Figure 15:
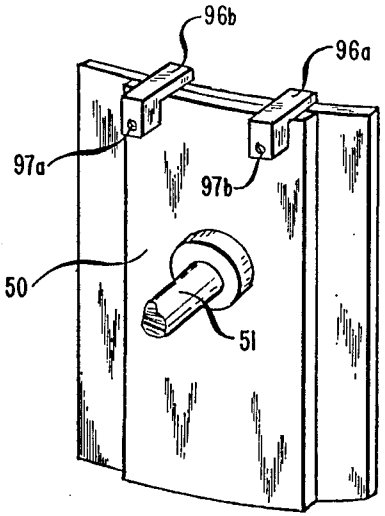
FIG. 15 shows the adapter connected on a movable shoe.
Figure 14:
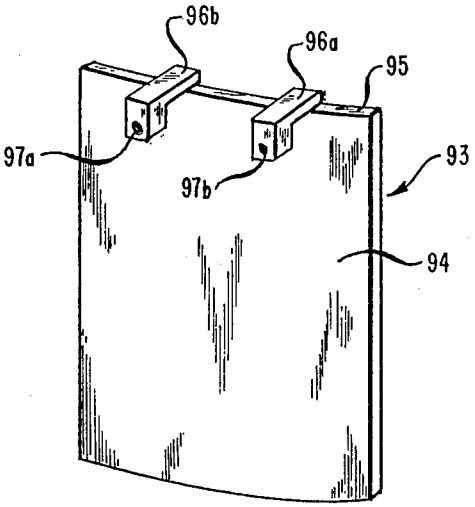
FIG. 14 is a back view of an adapter for increasing the width of either the fixed or movable shoe.

FIGS. 13, 14 and 15 show another form of wood bending machine in accordance with the present invention which is particularly adapted for increasing the area of contact and for more uniformly applying the pressure forces on the opposite side of the wooden member being bent. It is particularly adapted for bending of narrower widths of wooden members.

This is accomplished by two alternate types of assemblies which can be used independently of each other or combined as may produce the best result. In either alternative the machines although somewhat modified are basically identical with the above described form of the invention shown in FIGS. 1 to 12 of the drawings and therefore the corresponding parts are given the same number.

Figure 12:
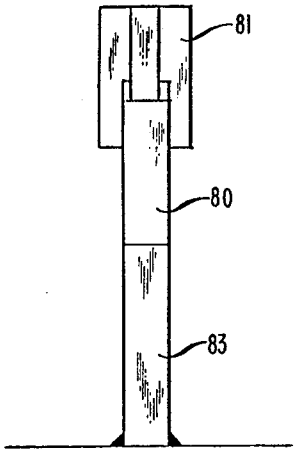
FIG. 12 is a rear end view of the wooden member levalor fixture support and levelor fixture mounted thereon shown in FIG. 12 taken on line 12—12 of FIG. 2.
Figure 11:
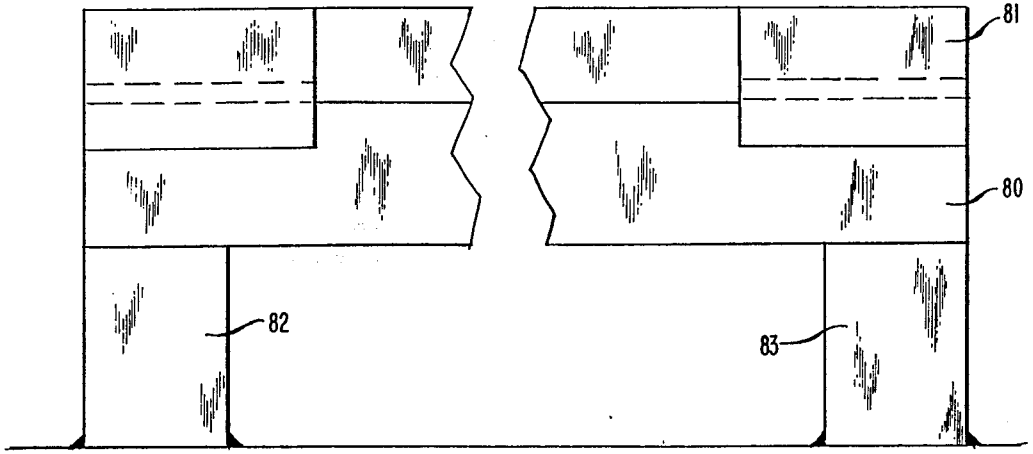
FIG. 11 is a side elevational view of one wooden member levelor fixture support with a levelor fixture mounted thereon.

In one of the alternate arrangements a pair of coacting platens as for example an inner platen 90 and an outer platen 91 as shown in FIG. 12 are disposed in the wood receiving space of the clamping assemblies 20*a* to 20*m* for contact on opposite sides of the wooden member to be bent and to coact with the elements of the bending machine for achieving this desirable end.

The platens 90 and 91 are elongated stainless steel plastic or other materials capable of withstanding the pressure forces acting during operation of the wood bending machines in accordance with the present invention.

Inner platen 90 is preferably fixed in position and thus will be connected to the respective inner faces 24*b* of the fixed shoes 24 on each of the clamping assemblies 20*a* to 20*m* as by removable clamps, one of which is shown at 92 disposed at spaced intervals along the inner platen. The inner platen can of course be connected by threaded members, not shown, when a production run for the bending of a plurality of wooden members is set up.

In this arrangement the outer platen 91 is positioned loosely against the side of the wooden member remote from the side of the wooden member in contact with the inner platen 90. This permits the outer platen to slide into the setting position as the bending forces and pressures are exerted by the machine and also permits the respective inner and outer platens 90 and 91 to distribute the forces being exerted across a larger area then is possible with the individual coacting fixed shoes 24 and movable shoes 50 of the clamping assembly 20*a* to 20*m*.

In another alternate form of the invention area expanding adapters as at 93 are formed to fit on the inner faces 50*b* of the movable shoes and/or the inner faces 24*b* of the fixed shoes for the same purpose and object as the inner and outer platens 90 and 91.

Thus, the area expanding adapters 93 are shown to consist of plate like members having a convex outer surface as at 94 and a concave inner surface as at 95 with spaced inverted L-type brackets as at 96*a* and 96*b* on the uppermost end which in assembled position as shown in FIGS. 13 and 15 fit snugly over the corresponding upper end of the movable shoe 24 so that the outer convex surface 94 will be disposed to engage the inner concave surface 24*b* of the movable shoe 24. The adapters 93 are held in assembled position on the movable shoes by threaded Allen screws as at 97*a* and 97*b* on the back legs of the L-type brackets 96*a* and 96*b* all of which is clearly shown in FIGS. 13, 14 and 15 of the drawings.

OPERATION

Whether the coacting inner and outer platens 90 and 91, the area expanding adapters 93 or combination of these arrangements are used, the operation of these alternate forms of the machines will remain the same.

Thus, the clamping assembly 20*a* to 20*m* after being set by the actuating assembly 30*a* to 30*m* as above described will be moved to open position. If the coacting inner and outer platens 90 and 91 are being used, the inner platen is fixed for engagement with the inner face 24*b* of the fixed shoes 24 and the wooden member to be bent is set in the center clamping unit 20*g* with the outer platen in assembled position against the outer face of the wooden member WM to be bent.

Then the clamping assemblies are operated serially on opposite sides of the central clamping assembly 20*g*. As has been above described progressively clamping the wooden member WM together with the backing or outer platen 91 against the inner platen 90 until all of the clamping assemblies 20*a* to 20*m* are engaged thus bending the wooden member into the desired arcuate form where it will remain until it is set.

In the case of the area expanding adapters 93 it will be obvious that this arrangement is identical with the form of the invention shown in FIGS. 1 to 12 except for the increased area established by the adapters against which the pressure forces can be applied when operating this form of the wood bending machine. Therefore, the operation will be identical with that above described for the form of the invention shown in FIGS. 1 to 12 of the drawings.

Those skilled in the art will readily recognize that one platen and one coacting set of area expanding adapters could also be used or both the platens and the adapters can be combined in various forms without departing from the scope and objects of these alternate forms of the present invention.

Thus, improved curved wood bending machines have been disclosed which are adapted for the mass production of curved windows, doors and othere devices such as sounding boards for pianos or structural frames for ships, trusses and for buildings and the like. However, it will be understood that the invention is not to be limited to the specific construction or arrangement of parts shown but that they may be widely modified within the invention defined by the claims.

What is claimed is:

1. A curved wood bending machine for bending elongated wooden members into predetermined shapes comprising, a. support means, b. a plurality of circumferentially spaced guide rails connected to the support means and each of said guide rails disposed to extend radially outward on said support means from a predetermined center point so the longitudinal line of each rail lies parallel to a predetermined radial plane, c. said guide rails having, an inner end and an outer end, d. a clamping assembly slidably mounted on each of said plurality of guide rails, and e. actuating means on each of said guide rails operatively connected to the associated clamping assembly on said guide rails to move the clamping assembly to and fro along the longitudinal line of the associated guide rail to enable the clamping assembly to be positioned relative each clamping assembly on the associated plurality of circumferentially spaced guide rails to establish a predetermined curved shape for bending said elongated wooden member in said curved wood bending machine.

2. A curved wood bending machine for bending elongated wooden members into predetermined shapes comprising, a. support means, b. a plurality of circumferentially spaced guide rails connected to the support means and each of said guide rails disposed to extend radially outward on said support means from a predetermined center point so the longitudinal line of each of said spaced guide rails lies parallel to a predetermined radial plane, c. said guide rails having, an inner end, and an outer end, d. a clamping assembly slidably mounted on each of said plurality of guide rails, e. each clamping assembly including, a sized base member having a sized vertically disposed shoe fixedly connected to the base member and movable therewith, and a plunger assembly pivotally connected to said base member for movement from a non-operating position to an operating position and vice versa relative the fixed vertical shoe on the associated base member, f. each plunger assembly having, a movable shoe, and means for moving said movable shoe towards and away from the fixed shoe when said plunger assembly is in the operating position, and g. actuating means on each of said guide rails operatively connected to an associated clamping assembly thereon to move the same to and fro along the longitudinal line of said associated guide rail.

3. A curved wood bending machine as claimed in claim 2 wherein;

a. each of said plurality of circumferentially spaced guide rails includes, spaced side members disposed parallel to the longitudinal line of each of the given guide rails, an inner end bracket connected to one end of said spaced side members, and an outer end bracket connected to the respective ends of the side members remote from the inner end bracket to hold the spaced side members in predetermined alignment with each other, and b. said end brackets having means thereon to hold each of said plurality of guide rails a predetermined distance above the support means.

4. A curved wood bending machine as claimed in claim 2 wherein;

a. said base member has a predetermined horizontal length approximately 5 ¼", and said fixed vertical shoe is substantially perpendicular to the base member and has a vertical height of approximately 12".

5. A curved wood bending machine as claimed in claim 1 wherein;

a. each clamping assembly is provided with a downwardly extending trunnion bearing having a threaded opening therethrough, b. the actuating means includes an elongated threaded member rotatably mounted in the outer end bracket and disposed to extend into the threaded opening in the trunnion bearing of the clamping assembly, and c. means for rotating the threaded member to move the clamping assembly to and fro along the longitudinal line of the support means.

6. A curved wood bending machine as claimed in claim 5 including, a detachable locking means on each of the actuating means movable into and out of engagement with the threaded member thereon to hold the associate clamping assembly in a predetermined position along the longitudinal length of the associated guide rail.

7. A curved wood bending machine as claimed in claim 2 wherein;

a. the plunger assembly on each clamping assembly includes, a cylinder, a piston slidable in said cylinder, means connecting said piston to the movable shoe, and fluid means for moving said piston means along the longitudinal line of the cylinder means, b. valve means for controlling flow of fluid to and from the said cylinder means on each plunger assembly for actuating the piston, and c. a fluid manifold, and d. means connecting said manifold to each of the valve means for providing a source of fluid for operating the respective piston means in each plunger assembly.

8. In a curved wood bending machine as claimed in claim 7 wherein each of said valve means includes, safety means to prevent accidental operation of the valve means.

9. In a curved wood bending machine as claimed in claim 8 wherein said safety means includes, a. knob means connected to the valve means, and b. a guard about said knob means, and c. access openings in the guard means to permit manual access to the knob means for operating the valve means.

10. A curved wood bending machine as claimed in claim 2 wherein;

a. an elongated platen is connected to the inner faces of the sized vertically fixedly connected shoes, and said elongated platen disposed for contact with the wooden member to be bent, b. means for enlarging the area of the inner faces of the movable shoes disposed for engagement between the side of the wooden member remote from the side in contact with the elongated platen and the movable shoes on the clamping assemblies.

11. A curved wood bending machine as claimed in claim 10 wherein, the means for enlarging the area of the inner faces of the movable shoes comprises a second elongated platen.

12. A curved wood bending machine as claimed in claim 10 wherein the means for enlarging the area of the inner face of the movable shoes includes, a. wide plate-like members having bracket means at the upper end thereof for connecting said plate-like member to a movable shoe, b. said plate-like member having a back surface shaped to match the concave inner surface of the movable shoe on the clamping assemblies when connected thereon, and c. said plate-like member having a front surface shaped to coact with the convex inner surface of the associated fixed shoe on the clamping assemblies during operation of the wood bending machine.

13. An adapter for enlarging the area of a movable shoe on a clamping assembly comprising, a. a wide plate-like member having a bracket means thereon for connecting the adapter onto the movable shoe, b. said plate-like member wider than the movable shoe, c. said plate-like member having an inner face and an outer face, d. the outer face of the plate-like member shaped to snugly engage the inner face of the movable shoe when the adapter is connected to the movable shoe, and e. the inner face of the plate-like member shaped for transferring the forces exerted by the movable shoe generally uniformly over the surface area of the inner face of the plate-like member.

14. In an adapter as claimed in claim 13 wherein the bracket means consits of an L-type member connected to the upper end of the plate-like member.

* * * * *